US009043121B2

(12) United States Patent
Kato et al.

(10) Patent No.: US 9,043,121 B2
(45) Date of Patent: May 26, 2015

(54) AIR-FUEL RATIO VARIATION ABNORMALITY DETECTING DEVICE AND AIR-FUEL RATIO VARIATION ABNORMALITY DETECTING METHOD

(71) Applicants: Toshihiro Kato, Toyota (JP); Isao Nakajima, Toyota (JP); Kiyotaka Kushihama, Nagoya (JP); Tatsuro Shimada, Toyota (JP); Shinichi Nakagoshi, Toyota (JP)

(72) Inventors: Toshihiro Kato, Toyota (JP); Isao Nakajima, Toyota (JP); Kiyotaka Kushihama, Nagoya (JP); Tatsuro Shimada, Toyota (JP); Shinichi Nakagoshi, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 333 days.

(21) Appl. No.: 13/772,935

(22) Filed: Feb. 21, 2013

(65) Prior Publication Data

US 2013/0226437 A1 Aug. 29, 2013

(30) Foreign Application Priority Data

Feb. 23, 2012 (JP) ..... 2012-037652

(51) Int. Cl.

| | |
|---|---|
| ***B60T 7/12*** | (2006.01) |
| ***G05D 1/00*** | (2006.01) |
| ***G06F 7/00*** | (2006.01) |
| ***G06F 17/00*** | (2006.01) |
| ***F02D 41/30*** | (2006.01) |
| ***F02D 41/14*** | (2006.01) |
| *F02D 41/22* | (2006.01) |

(52) U.S. Cl.
CPC ..... *F02D 41/30* (2013.01); *F02D 41/1441* (2013.01); *F02D 41/1495* (2013.01); *F02D 41/221* (2013.01); *F02D 41/3094* (2013.01)

(58) Field of Classification Search
CPC ..... F02D 41/0025; F02D 41/3094; F02D 19/0692; F02D 41/1454; F02M 69/046
USPC ..... 73/114.31, 114.38, 114.45; 123/198 D, 123/299, 300, 479; 701/103, 104, 107
See application file for complete search history.

(56) References Cited

U.S. PATENT DOCUMENTS

| | | | | |
|---|---|---|---|---|
| 5,730,111 | A | 3/1998 | Kaji et al. | |
| 8,548,718 | B2 * | 10/2013 | Kato et al. | 701/107 |
| 8,805,609 | B2 * | 8/2014 | Tanaka et al. | 701/107 |
| 2009/0198434 | A1 | 8/2009 | Tanaka et al. | |
| 2009/0211350 | A1 * | 8/2009 | Iwazaki et al. | 73/114.72 |
| 2010/0168986 | A1 * | 7/2010 | Iwazaki et al. | 701/103 |
| 2010/0211290 | A1 * | 8/2010 | Kidokoro et al. | 701/103 |
| 2012/0277979 | A1 | 11/2012 | Kato et al. | |

FOREIGN PATENT DOCUMENTS

| | | | |
|---|---|---|---|
| JP | 63-050645 | A | 3/1988 |
| JP | 08-338285 | A | 12/1996 |
| JP | 2001-241348 | A | 9/2001 |
| JP | 2009-180171 | A | 8/2009 |
| JP | 2009-185741 | A | 8/2009 |
| JP | 2012-233425 | A | 11/2012 |

* cited by examiner

*Primary Examiner* — Mahmoud Gimie
*Assistant Examiner* — Sizo Vilakazi
(74) *Attorney, Agent, or Firm* — Gifford, Krass, Sprinkle, Anderson & Citkowski, P.C.

(57) ABSTRACT

In an engine having a plurality of cylinders in which a plurality of fuel injection valves are provided respectively, fuel is injected at a predetermined injection ratio, and an abnormality of air-fuel ratio variation is detected. If a fuel injection amount of at least one of the plurality of the fuel injection valves is smaller than a predetermined reference value, the fuel injection amount is increased so as to become equal to or larger than the reference value.

4 Claims, 8 Drawing Sheets

CRANK ANGLE (°CA)

A/F

CRANK ANGLE
(°CA)
720
0
t1
ONE CYCLE
t2

A/F
ΔA/Fn
ΔA/Fn
τ
n-1
n
n-1
n
TIME

AIR-FUEL RATIO VARIATION ABNORMALITY DETECTING DEVICE AND AIR-FUEL RATIO VARIATION ABNORMALITY DETECTING METHOD

INCORPORATION BY REFERENCE

The disclosure of Japanese Patent Application No. 2012-037652 filed on Feb. 23, 2012 including the specification, drawings and abstract is incorporated herein by reference in its entirety.

BACKGROUND OF THE INVENTION

1. Field of the Invention

The invention relates to a device and a method for detecting an abnormality of variation of air-fuel ratio among cylinders. In particular, the invention relates to a device and a method that detect that the air-fuel ratio is relatively greatly varied among cylinders in a multi-cylinder internal combustion engine.

2. Description of Related Art

In general, in an internal combustion engine that is equipped with an exhaust gas purification system that utilizes a catalyst, noxious components in exhaust gas are highly efficiently purified by the catalyst. Thus, the control of the mixing ratio between air and fuel in the air-fuel mixture burned in the internal combustion engine, namely, the air-fuel ratio is indispensable. In order to control this air-fuel ratio, an air-fuel ratio sensor is provided in an exhaust passage of the internal combustion engine, and feedback control is performed such that an air-fuel ratio detected by this air-fuel ratio sensor coincides with a predetermined target air-fuel ratio.

On the other hand, in the multi-cylinder internal combustion engine, the same controlled variable is usually used for all the cylinders to perform air-fuel ratio control. Thus, even when air-fuel ratio control is performed, the actual air-fuel ratio may vary among the cylinders. In this case, if the degree of variation is small, the variation can be absorbed through air-fuel ratio feedback control, and noxious components in exhaust gas can be treated to be purified by the catalyst as well. Therefore, the exhaust emission properties are not influenced, and no problem is caused in particular.

However, for example, if the air-fuel ratio greatly varies among the cylinders due to a malfunction in a fuel injection system or fuel injection systems in one or some of the cylinders or the like, the exhaust emission properties deteriorate to such a degree as to cause a problem. Such a great air-fuel ratio variation as to cause a deterioration in the exhaust emission properties is desired to be detected as an abnormality. In particular, in the case of an internal combustion engine for a motor vehicle, there have been demands to detect an abnormality of variation of air-fuel ratio among the cylinders in an in-vehicle state (onboard) in order to prevent vehicles whose exhaust emission properties have deteriorated from traveling. Recently, there have also been moves to enshrine this detection into law.

For example, in a device described in Japanese Patent Application Publication No. 2009-180171 (JP-2009-180171 A), an abnormality of variation of air-fuel ratio among the cylinders is detected on the basis of fluctuations in the air-fuel ratio of the internal combustion engine. Furthermore, as for a plurality of fuel injection valves provided in a plurality of the cylinders respectively, the injection ratio among the plurality of these fuel injection valves is changed among a plurality of predetermined ratios. It is then identified, on the basis of fluctuations in the air-fuel ratio before and after this change, which one of the fuel injection valves constitutes a cause of the variation abnormality.

However, in the configuration of Japanese Patent Application Publication No. 2009-180171 (JP-2009-180171 A), if the injection amount of any one of the fuel injection valves is small when the injection ratio is changed, the accuracy of the control of the injection amount becomes low. Therefore, a targeted air-fuel ratio cannot be realized. For this reason, it may become difficult to identify which one of the fuel injection valves is abnormal.

SUMMARY OF THE INVENTION

Thus, the invention provides an air-fuel ratio variation abnormality detecting device and an air-fuel ratio variation abnormality detecting method that identify which one of a plurality of fuel injection valves provided in a plurality of cylinders respectively constitutes a cause of a variation abnormality, while restraining the accuracy of injection amount control from deteriorating.

In a first aspect of the invention, there is provided an air-fuel ratio variation abnormality detecting device for an internal combustion engine. The internal combustion engine is equipped with a plurality of cylinders and a plurality of fuel injection valves that are provided in the plurality of the cylinders respectively. The air-fuel ratio variation abnormality detecting device includes a controller that is configured to calculate a required fuel injection amount that fulfills an operation condition of the internal combustion engine, calculate fuel injection amounts, namely, amounts of fuel injected from the plurality of the fuel injection valves respectively based on the required fuel injection amount, incrementally correct at least one of the fuel injection amounts such that the fuel injection amount becomes equal to or larger than a predetermined reference value, if the fuel injection amount is smaller than the reference value, set a first injection ratio and a second injection ratio based on the incrementally corrected fuel injection amount, the first injection ratio and the second injection ratio are ratios between an amount of fuel from at least one first fuel injection valve and an amount of fuel injection from remaining second fuel injection valve in one cylinder respectively, and the first injection ratio and the second injection ratio have different value respectively, and detect an abnormality of air-fuel ratio variation based on fluctuations in a predetermined output of the internal combustion engine at a time when fuel is injected at the first injection ratio and at a time when fuel is injected at the second injection ratio.

The accuracy of the amount of injection from each of the fuel injection valves may deteriorate in a range where the amount of injection is small. However, in the first aspect of the invention, if the fuel injection amount of at least one of the plurality of the fuel injection valves in the case where fuel is injected at a predetermined injection ratio for detecting an abnormality of air-fuel ratio variation is smaller than the predetermined reference value, the controller incrementally corrects the fuel injection amount such that the fuel injection amount becomes equal to or larger than the reference value. Accordingly, it is possible to restrain the accuracy of injection amount control from deteriorating, and favorably identify which one of the fuel injection valves constitutes a cause of an abnormality of variation. This predetermined reference value can be determined as a limit at which a deterioration in the accuracy of the injection amount can be tolerated.

The controller may incrementally correct the amount of fuel injection from the second fuel injection valve as well at a ratio corresponding to an incremental correction when the amount of fuel injection from the first injection valve is incrementally corrected.

In this aspect of the invention, a predetermined injection ratio for detecting an abnormality of variation can be maintained while restraining the accuracy of injection amount control from deteriorating.

The controller may perform an air-fuel ratio feedback processing of calculating an air-fuel ratio feedback correction amount such that an air-fuel ratio of exhaust gas coincides with a target air-fuel ratio and correcting a fuel injection amount using the air-fuel ratio feedback correction amount, an air-fuel ratio learning processing of learning an air-fuel ratio learning value, which compensates for a steady deviation between an engine air-fuel ratio and a theoretical air-fuel ratio, on the basis of the air-fuel ratio feedback correction amount and causing the feedback processing to reflect the learned air-fuel ratio learning value, and a prohibition processing of prohibiting the air-fuel ratio feedback processing and the air-fuel ratio learning processing from being performed while the incremental correction is carried out.

In this aspect of the invention, the controller prohibits the air-fuel ratio feedback processing and the air-fuel ratio learning processing from being performed while the incremental correction is carried out. Accordingly, the air-fuel ratio feedback processing and the air-fuel ratio learning processing can be restrained from being influenced as a result of an increase in the fuel injection amount.

In a second aspect of the invention, there is provided an air-fuel ratio variation abnormality detecting method for an internal combustion engine. The internal combustion engine is equipped with a plurality of cylinders and a plurality of fuel injection valves that are provided for the plurality of the cylinders respectively. The air-fuel ratio variation abnormality detecting method includes calculating a required fuel injection amount that fulfills an operation condition of the internal combustion engine, calculating amounts of fuel injected from the plurality of the fuel injection valves respectively based on the required fuel injection amount, incrementally correcting at least one of the fuel injection amounts such that the fuel injection amount becomes equal to or larger than a predetermined reference value if the fuel injection amount is smaller than the reference value, setting a first injection ratio and a second injection ratio based on the incrementally corrected fuel injection amount, the first injection ratio and the second injection ratio are ratios between an amount of fuel injection from at least one first fuel injection valve and an amount of fuel injection from remaining second fuel injection valve in one cylinder respectively, and the first injection ratio and the second injection ratio have different value respectively, and detecting an abnormality of air-fuel ratio variation based on fluctuations in a predetermined output of the internal combustion engine at a time when fuel is injected at the first injection ratio and at a time when fuel is injected at the second injection ratio.

BRIEF DESCRIPTION OF THE DRAWINGS

Features, advantages, and technical and industrial significance of an exemplary embodiment of the invention will be described below with reference to the accompanying drawings, in which like numerals denote like elements, and wherein.

DETAILED DESCRIPTION OF EMBODIMENT

The embodiment of the invention will be described hereinafter on the basis of the accompanying drawings.

Figure 1:
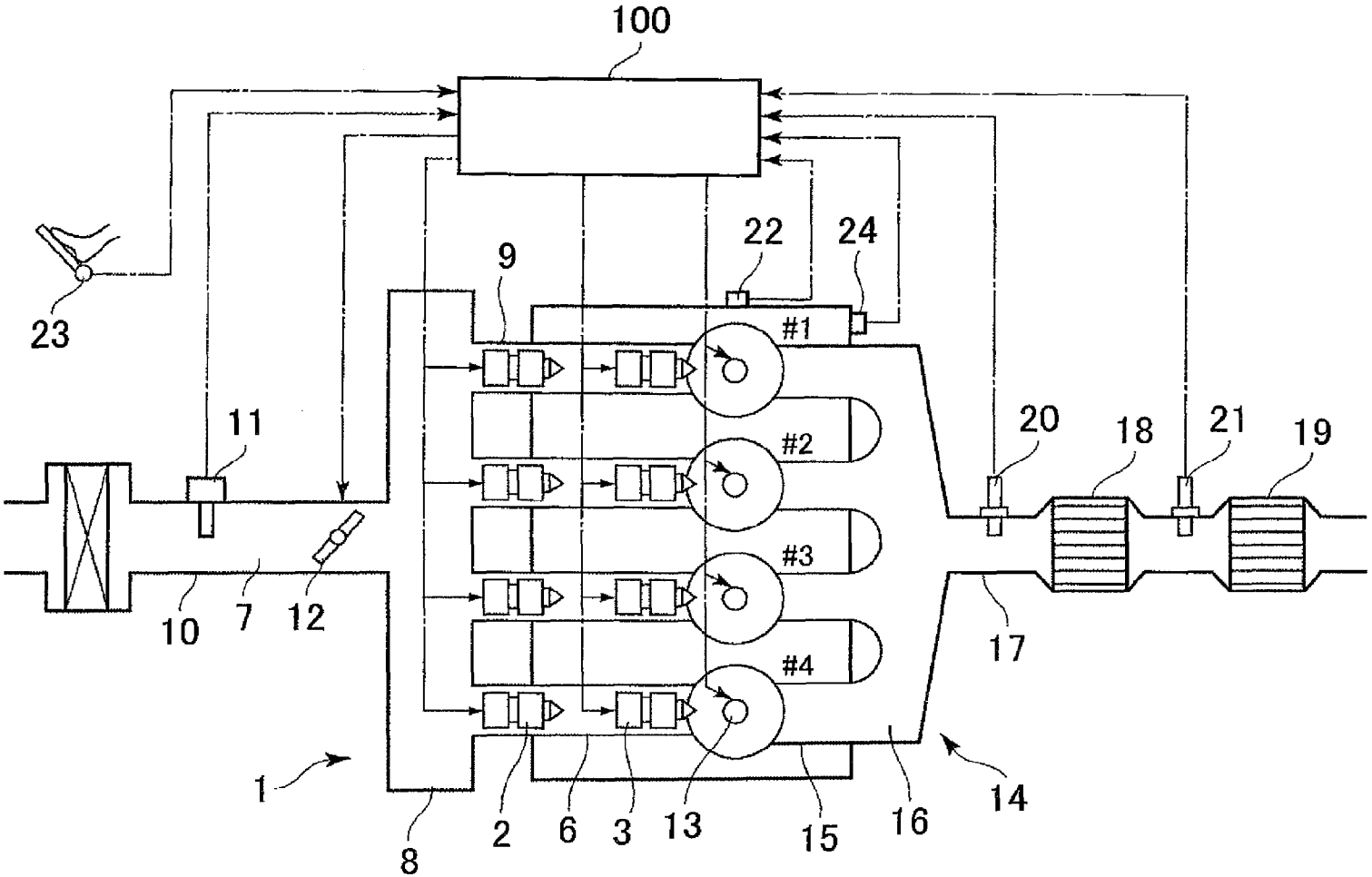
FIG. 1 is a schematic view of an internal combustion engine according to the embodiment of the invention.

FIG. 1 schematically shows an internal combustion engine 1 according to the embodiment of the invention. The internal combustion engine (the engine) 1 shown in FIG. 1 is an inline four-cylinder dual injection-type gasoline engine. An injector 2 for injecting fuel into an intake passage and an injector 3 for injecting fuel into a cylinder are provided in each of cylinders #1 to #4.

The injector 2 for injecting fuel into an intake passage injects fuel toward the interior of an intake passage, especially an intake port 6 of a corresponding one of the cylinders, so as to realize so-called homogeneous combustion. The injector for injecting fuel into an intake passage will be referred to hereinafter as "a PFI" as well. On the other hand, the injector 3 for injecting fuel into a cylinder directly injects fuel toward the interior of a corresponding one of the cylinders (the interior of a combustion chamber), so as to realize so-called stratified combustion. The injector for injecting fuel into a cylinder will be referred to hereinafter as "a DI" as well.

An intake passage 7 for introducing intake air includes a surge tank 8 as an assembly portion, a plurality of intake manifolds 9 that link the intake ports 6 of the respective cylinders with the surge tank 8, and an intake pipe 10 located upstream of the surge tank 8, as well as the intake port 6. The intake pipe 10 is provided, sequentially from an upstream side thereof, with an airflow meter 11 and an electronically controlled throttle valve 12. The airflow meter 11 outputs a signal corresponding in magnitude to an intake air flow rate. Each of the cylinders is provided with an ignition plug 13 for igniting the air-fuel mixture in the cylinder.

An exhaust passage 14 for discharging exhaust gas includes exhaust ports 15 of the respective cylinders, an exhaust manifold 16 for gathering exhaust gases in these exhaust ports 15, and an exhaust pipe 17 that is connected to a downstream end of the exhaust manifold 16. In addition, catalysts configured as three-way catalysts, namely, an upstream catalyst 18 and a downstream catalyst 19 are provided in series on an upstream side and a downstream side of the exhaust pipe 17 respectively. Air-fuel ratio sensors for detecting air-fuel ratios of exhaust gas, namely, a pre-catalyst sensor 20 and a post-catalyst sensor 21 are installed upstream and downstream of the upstream catalyst 18 respectively. Each of these sensors, namely, the pre-catalyst sensor 20 and the post-catalyst sensor 21 detects an air-fuel ratio on the basis of a concentration of oxygen in exhaust gas. In this manner, the sensors 20 and 21 that are common to all the cylinders are installed in the assembly portion of the exhaust passage 14.

The PFI's 2, the DI's 3, the throttle valve 12, the ignition plugs 13 as described above and the like are electrically connected to an electronically controlled unit (hereinafter referred to as an ECU) 100 as a controller. The ECU 100 includes a CPU (not shown), a ROM (not shown), a RAM (not shown), input/output ports (not shown), and a storage device (not shown). As shown in FIG. 1, in addition to the airflow meter 11, the pre-catalyst sensor 20, and the post-catalyst sensor 21 as mentioned above, a crank angle sensor 22 for detecting a crank angle of the engine 1, an accelerator opening degree sensor 23 for detecting an accelerator opening degree, a coolant temperature sensor 24 for detecting a temperature of coolant of the engine 1, and various other sensors are electrically connected to the ECU 100 via A/D converters (not shown). The ECU 100 controls various actuators including the PFI's 2, the DI's 3, the throttle valve 12, and the ignition plugs 13 on the basis of values detected by the various sensors such that desired outputs are obtained, thereby controlling the fuel injection amount, the fuel injection timing, the throttle opening degree, the ignition timing, and the like. Besides, the ECU 100 detects a crank angle of the engine 1 on the basis of an output of the crank angle sensor 22, and calculates a rotational speed of the engine.

Figure 2:
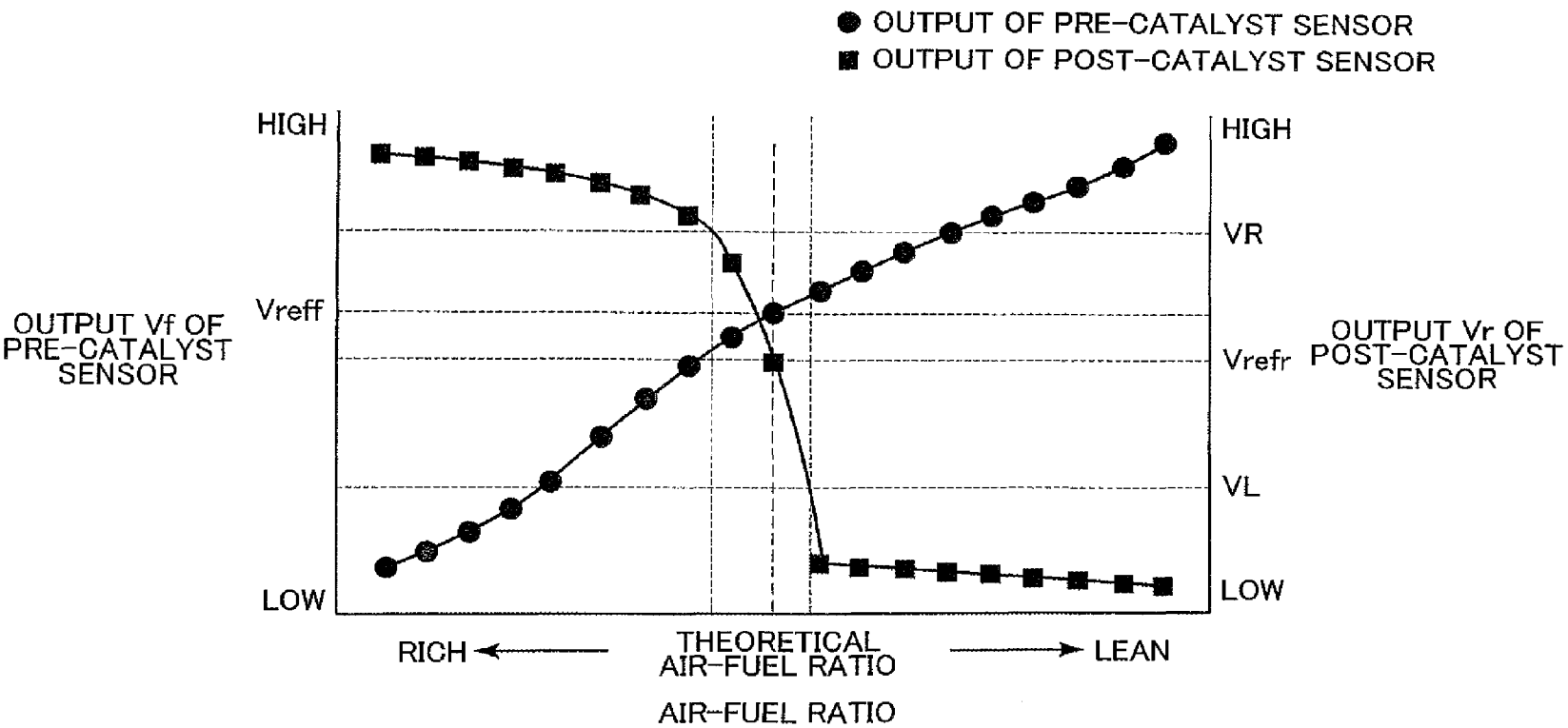
FIG. 2 is a graph showing output characteristics of a pre-catalyst sensor and a post-catalyst sensor.

The pre-catalyst sensor 20 is configured as a so-called wide-range air-fuel ratio sensor, and successively detects air-fuel ratios over a relatively wide range. FIG. 2 shows an output characteristic of the pre-catalyst sensor 20. As shown in FIG. 2, the pre-catalyst sensor 20 outputs a voltage signal Vf whose magnitude is proportional to the air-fuel ratio of exhaust gas. The output voltage at the time when the air-fuel ratio of exhaust gas is stoichiometric (a theoretical air-fuel ratio, e.g., A/F=14.6) is Vreff (e.g., about 3.3 V).

On the other hand, the post-catalyst sensor 21 is configured as a so-called $O_2$ sensor, and has such a characteristic that the output value thereof suddenly changes across the stoichiometric air-fuel ratio. FIG. 2 shows an output characteristic of the post-catalyst sensor 21. As shown in FIG. 2, the output voltage at the time when the air-fuel ratio of exhaust gas is stoichiometric, namely, the stoichiometric equivalent value is Vrefr (e.g., 0.45 V). The output voltage of the post-catalyst sensor 21 changes within a predetermined range (e.g., 0 to 1 (V)). When the air-fuel ratio of exhaust gas is leaner than the stoichiometric air-fuel ratio, the output voltage of the post-catalyst sensor is lower than the stoichiometric equivalent value Vrefr. When the air-fuel ratio of exhaust gas is richer than the stoichiometric air-fuel ratio, the output voltage of the post-catalyst sensor is higher than the stoichiometric equivalent value Vrefr.

Each of the upstream catalyst 18 and the downstream catalyst 19 simultaneously purifies NOx, HC, and CO as noxious components in exhaust gas when an air-fuel ratio A/F of exhaust gas flowing thereinto is in the neighborhood of the stoichiometric air-fuel ratio. The width (window) of the air-fuel ratio that allows these three components to be purified at the same time with high efficiency is relatively narrow.

The ECU 100 performs air-fuel ratio feedback control (stoichiometric control) in such a manner as to control the air-fuel ratio of exhaust gas flowing into the upstream catalyst 18 to the neighborhood of the stoichiometric air-fuel ratio. This air-fuel ratio feedback control consists of main air-fuel ratio control (main air-fuel ratio feedback control) for making the air-fuel ratio of exhaust gas detected by the pre-catalyst sensor 20 coincident with the stoichiometric air-fuel ratio as a predetermined target air-fuel ratio, and auxiliary air-fuel ratio control (auxiliary air-fuel ratio feedback control) for making the air-fuel ratio of exhaust gas detected by the post-catalyst sensor 21 coincident with the stoichiometric air-fuel ratio.

In either of main air-fuel ratio control and auxiliary air-fuel ratio control, while the detected air-fuel ratio is richer than the stoichiometric air-fuel ratio as the target air-fuel ratio, a value for gradually reducing the fuel injection amount is given as an air-fuel ratio feedback correction coefficient $\gamma$. When the detected air-fuel ratio has changed to become lean, a value for increasing the fuel injection amount is given in a skip manner as the air-fuel ratio feedback correction coefficient $\gamma$ for the sake of the enhancement of responsiveness.

On the contrary, while the detected air-fuel ratio is leaner than the stoichiometric air-fuel ratio as the target air-fuel ratio, a value for gradually increasing the fuel injection amount is given as the air-fuel ratio feedback correction coefficient $\gamma$. When the detected air-fuel ratio has changed to become rich, a value for reducing the fuel injection amount is given in a skip manner as the air-fuel ratio feedback correction coefficient $\gamma$ for the sake of the enhancement of responsiveness. In this manner, the air-fuel ratio feedback correction coefficient $\gamma$ is generated to constantly hold the air-fuel ratio equal to the target air-fuel ratio.

Furthermore, the ECU 100 performs an air-fuel ratio learning processing to be reflected by feedback control. In this air-fuel ratio learning processing, the ECU 100 learns an air-fuel ratio learning value for compensating for a steady deviation between the air-fuel ratio of the engine and the theoretical air-fuel ratio on the basis of an air-fuel ratio feedback correction amount, and causes the feedback processing to reflect the air-fuel ratio learning value thus learned. For example, a predetermined reference value is subtracted from an average of a latest stored value of the air-fuel ratio feedback coefficient at the time of inversion from the rich side to the lean side and a latest stored value of the air-fuel ratio feedback coefficient at the time of inversion from the lean side to the rich side, and a value obtained by multiplying the deviation by a predetermined learning gain G ($0<G<1$) is added to a current learning value.

Besides, in this embodiment of the invention, injection distribution is carried out to allocate a total amount of fuel injected during one injection cycle in one cylinder to each of the PFI's 2 and each of the DI's 3 in accordance with predetermined injection ratios $\alpha$ and $\beta$. In this case, the ECU 100 sets an amount of fuel injected from the PFI 2 (which is referred to as a port injection amount) and an amount of fuel injected from the DI 3 (which is referred to as an in-cylinder injection amount) in accordance with the injection ratios $\alpha$ and $\beta$, and performs energization control of the respective injectors 2 and 3 in accordance with these fuel amounts. In this case, the injection ratio $\alpha$ or $\beta$ means the percentage value of the port injection amount or the in-cylinder injection amount to the total fuel injection amount, and ranges from 0 to 100 ($\beta=100-\alpha$). Given that the total fuel injection amount is denoted by Qt, a port injection amount Qp is expressed as $\alpha\times Qt/100$, and an in-cylinder injection amount Qd is expressed as $\beta\times Qt/100$. The injection ratio between both the injection amounts is $Qp:Qd=\alpha:\beta$. In this manner, the injection ratios $\alpha$ and $\beta$ are values that define an injection ratio between the PFI's 2 and the DI's 3 or between the port injection amount Qp and the in-cylinder injection amount Qd. The total fuel injection amount is set on the basis of an engine operation state (e.g., an engine rotational speed and a load) by the ECU 100.

Figure 3:
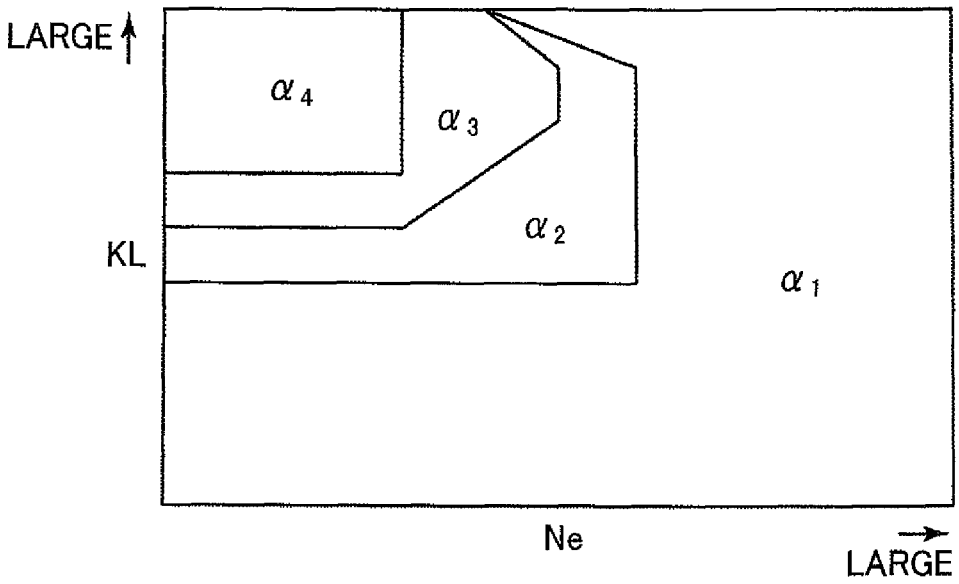
FIG. 3 is a map for setting an injection ratio.

FIG. 3 shows a map for setting the injection ratio $\alpha$. As shown in FIG. 3, the injection ratio $\alpha$ changes from $\alpha$1 to $\alpha$4 in accordance with respective ranges defined by an engine rotational speed Ne and a load KL. For example, $\alpha$1=0, $\alpha$2=35, $\alpha$3=50, and $\alpha$4=70. However, these values and the division of the ranges can be arbitrarily changed. In this example, the ratio of the port injection amount increases as the rotational speed decreases and as the load increases. Besides, in the range of $\alpha=\alpha 1$, injection distribution is not carried out, and fuel is supplied through in-cylinder injection alone.

Meanwhile, it is assumed, for example, that the injector or injectors of one or some out of all the cylinders malfunctions or malfunction to cause a variation (an imbalance) of air-fuel ratio among the cylinders. In an example of such cases, the fuel injection amount of the cylinder #1 becomes larger than the fuel injection amounts of the other cylinders #2 to #4, so that the air-fuel ratio of the cylinder #1 more greatly deviates to the rich side than the air-fuel ratios of the other cylinders #2 to #4. At this time, if a relatively large correction amount is given through the aforementioned main air-fuel ratio feedback control as to all the cylinders, it may be possible to control the air-fuel ratio of the entire gas to the stoichiometric air-fuel ratio. However, when each of the cylinders is observed, the air-fuel ratio of the cylinder #1 is much richer than the stoichiometric air-fuel ratio, and the air-fuel ratios of the cylinders #2, #3, and #4 are leaner than the stoichiometric air-fuel ratio. This simply means that the air-fuel ratio of the cylinders as a whole is stoichiometric, which is obviously undesirable from the standpoint of emission properties. Thus, in this embodiment of the invention, a processing of detecting such an abnormality of variation of air-fuel ratio among the cylinders is implemented.

Figures 4A, 4B:
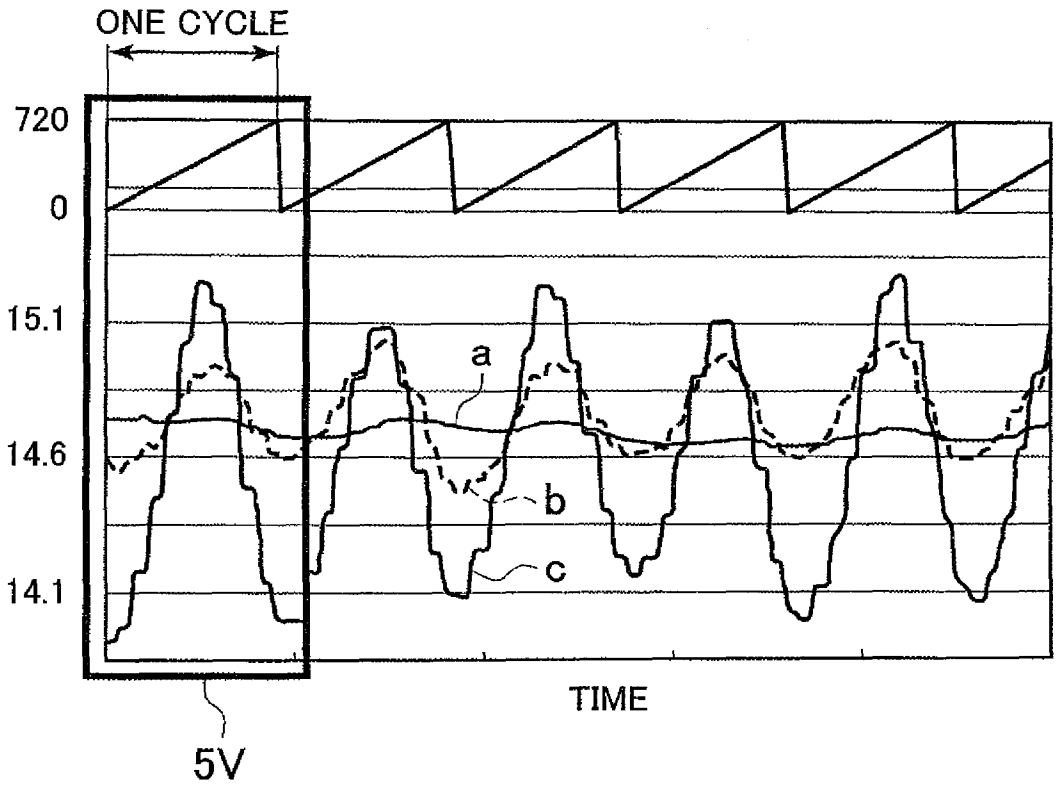
FIGS. 4A and 4B are time charts showing fluctuations in output of an air-fuel ratio sensor.

FIGS. 4A and 4B show fluctuations in the output of the air-fuel ratio sensor in the engine 1. As shown in FIGS. 4A and 4B, the air-fuel ratio A/F of exhaust gas detected by the air-fuel ratio sensor tends to periodically fluctuate on a cycle corresponding to one engine cycle (=720° CA). In addition, when there occurs a variation of air-fuel ratio among the cylinders, the amplitude of fluctuations in the air-fuel ratio A/F of exhaust gas within one engine cycle increases. Air-fuel ratio diagrams a, b, and c of FIG. 4B indicate that there is no variation of air-fuel ratio among the cylinders, that only the air-fuel ratio of one of the cylinders is deviant to the rich side at an imbalance ratio of 20%, and that only the air-fuel ratio of one of the cylinders is deviant to the rich side at an imbalance ratio of 50%, respectively. As is observed, the amplitude of fluctuations in the air-fuel ratio increases as the degree of variation increases.

It should be noted herein that the imbalance ratio (%) is a parameter representing a degree of variation of air-fuel ratio among the cylinders. That is, the imbalance ratio is a value indicating the ratio at which the fuel injection amount of that one of the cylinders whose fuel injection amount is deviant (an imbalanced cylinder) is deviant from the fuel injection amount of the cylinders whose fuel injection amount is not deviant (balanced cylinders), namely, a reference injection amount in the case where the fuel injection amount of only one out of all the cylinders is deviant. Given that the imbalance ratio is denoted by IB, that the fuel injection amount of the imbalanced cylinder is denoted by Qib, and that the fuel injection amount of the balanced cylinders, namely, the reference injection amount is denoted by Qs, there is established a relationship: IB=(Qib−Qs)/Qs. As the imbalance ratio IB increases, the deviation of the fuel injection amount of the imbalanced cylinder from the fuel injection amount of the balanced cylinders increases, and the degree of air-fuel ratio variation increases.

[Detection of Abnormality of Variation of Air-fuel Ratio among Cylinders] As is understood from the foregoing description, when an abnormality of air-fuel ratio variation occurs, the amplitude of fluctuations in the output of the air-fuel ratio sensor increases. It is thus possible to detect the abnormality of variation on the basis of these fluctuations in the output.

It should be noted herein that the abnormality of variation has two variants, namely, a rich deviation abnormality with the fuel injection amount of one of the cylinders deviant to the rich side (the excessively large side), and a lean deviation abnormality with the fuel injection amount of one of the cylinders deviant to the lean side (the excessively small side). In this embodiment of the invention, a rich deviation abnormality is detected on the basis of fluctuations in the output of the air-fuel ratio sensor. However, a lean deviation abnormality may be detected, or an abnormality of variation in a broad sense may be detected without making a distinction between a rich deviation abnormality and a lean deviation abnormality.

In detecting a rich deviation abnormality, an air-fuel ratio fluctuation parameter as a parameter correlated with the degree of fluctuations in the output of the air-fuel ratio sensor is calculated, and this air-fuel ratio fluctuation parameter is compared with a predetermined abnormality criterial value to detect the abnormality. It should be noted herein that the abnormality is detected using the output of the pre-catalyst sensor 20 as an air-fuel ratio sensor.

Figures 5A, 5B:
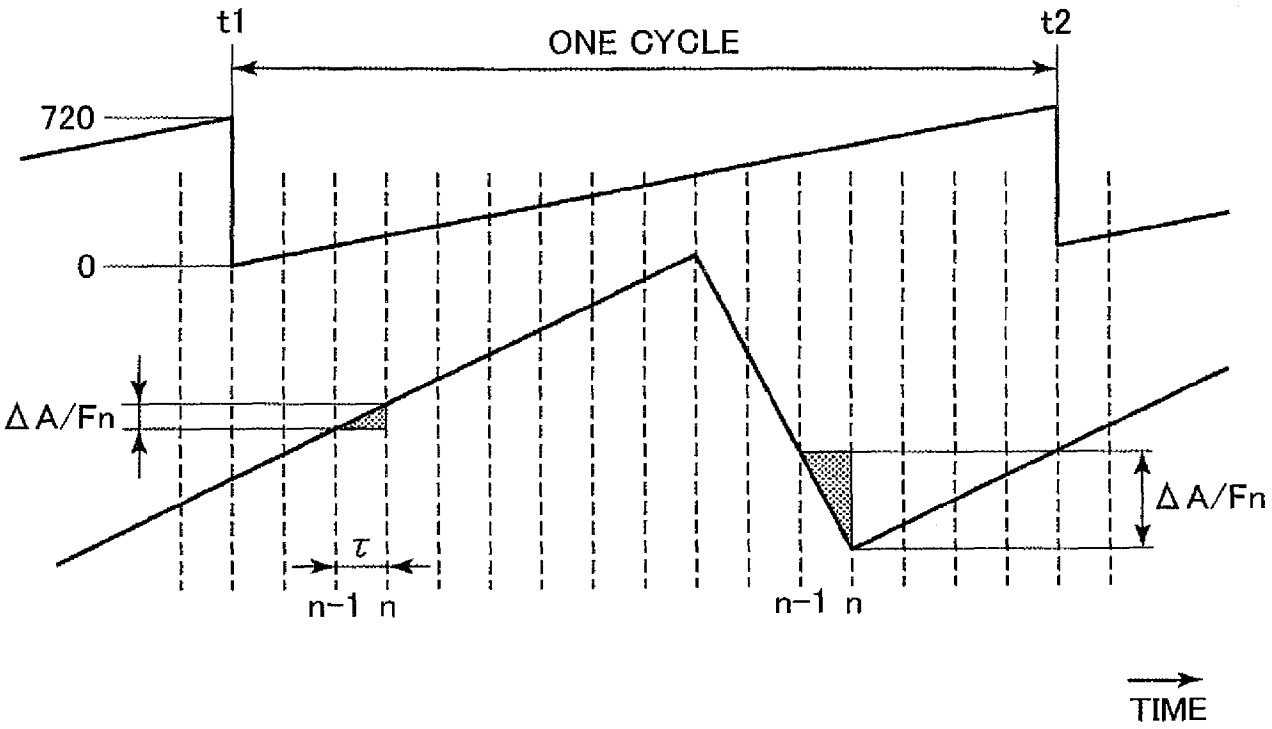
FIGS. 5A and 5B are enlarged views corresponding to a 5V region of FIG. 4.

A method of calculating an air-fuel ratio fluctuation parameter will be described hereinafter. FIGS. 5A and 5B are enlarged views corresponding to 5V regions of FIGS. 4A and 4B respectively, and especially show fluctuations in the output of the pre-catalyst sensor within one engine cycle. As the output of the pre-catalyst sensor, a value obtained by converting an output voltage Vf of the pre-catalyst sensor 20 into the air-fuel ratio A/F is used. It should be noted, however, that the output voltage Vf of the pre-catalyst sensor 20 can be directly used as well.

As shown in FIG. 5B, the ECU 100 acquires a value of the pre-catalyst sensor A/F on a predetermined sample cycle $\tau$ (unit time, e.g., 4 ms) within one engine cycle. The ECU 100 then obtains an absolute value of a difference $\Delta A/F_n$ between a value $A/F_n$ acquired at the current timing (a second timing) and a value $A/F_{n-1}$ acquired at the last timing (a first timing) according to an expression (1) shown below. This difference $\Delta A/F_n$ can be reworded as a derivative value or a gradient at the current timing.

[Expression 1]

$$\Delta A/F_n = A/F_n - A/F_{n-1} \quad (1)$$

Most simply, this difference $\Delta A/F_n$ represents fluctuations in the output of the pre-catalyst sensor. As the degree of fluctuations increases, the gradient of the air-fuel ratio diagram increases, and the difference $\Delta A/F_n$ increases. A value of the difference $\Delta A/F_n$ at one predetermined timing can be adopted as the air-fuel ratio fluctuation parameter.

It should be noted, however, that an average of a plurality of differences $\Delta A/F_n$ is adopted as the air-fuel ratio fluctuation parameter in this embodiment of the invention for the sake of the enhancement of accuracy. In this embodiment of the invention, within one engine cycle, the difference $\Delta A/F_n$ is integrated at each timing, a final integrated value is divided by a sample number N, and an average of the differences $\Delta A/F_n$ within one engine cycle is obtained. Furthermore, an average of the differences $\Delta A/F_n$ corresponding to M engine cycles (e.g., M=100) is integrated, a final integrated value is divided by a cycle number M, and an average of the differences $\Delta A/F_n$ within M engine cycles is obtained. The final average thus obtained is adopted as the air-fuel ratio fluctuation parameter, and will be denoted hereinafter by "X".

The air-fuel ratio fluctuation parameter X increases as the degree of fluctuations in the output of the pre-catalyst sensor increases. Thus, it is determined that there is an abnormality if the air-fuel ratio fluctuation parameter X is equal to or larger than a predetermined abnormality criterial value, and it is determined that there is no abnormality, namely, that there is a normality if the air-fuel ratio fluctuation parameter X is smaller than the abnormality criterial value. Incidentally, owing to a cylinder discrimination function of the ECU 100, the ignited cylinder can be associated with the air-fuel ratio fluctuation parameter X corresponding thereto.

Incidentally, the output A/F of the pre-catalyst sensor may increase or decrease. The aforementioned difference $\Delta A/F_n$ or the average thereof can be obtained only in each of these cases, so as to be adopted as the fluctuation parameter. In particular, in the case where the air-fuel ratio of only one of the cylinders is deviant to the rich side, when the pre-catalyst sensor receives exhaust gas corresponding to that one of the cylinders, the output of the pre-catalyst sensor rapidly changes to the rich side (i.e., rapidly decreases). Thus, it is also possible to use only the value on the decrease side to detect a rich deviation (a rich imbalance determination). In this case, only a downward-sloping range in the graph of FIG. 5B is utilized to detect a rich deviation. In general, a transition from the lean side to the rich side is often made more precipitously than a transition from the rich side to the lean side. Thus, according to this method, accurate detection of a rich deviation can be expected. However, the invention is not limited to this method. It is also possible to use only the value on the increase side, or both the value on the decrease side and the value on the increase side (by integrating an absolute value of the difference $\Delta A/F_n$ and comparing this integrated value with a threshold).

Figure 6:
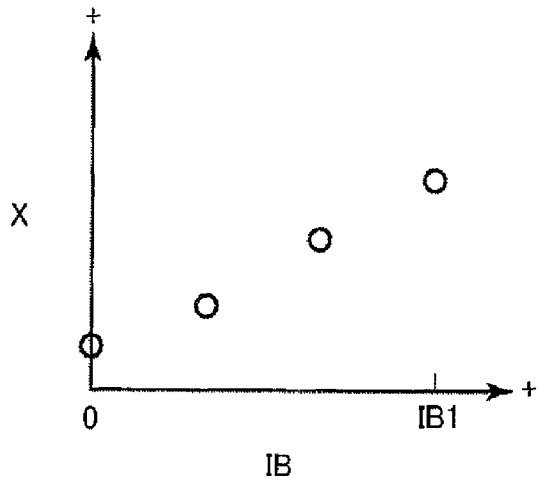
FIG. 6 is a graph showing a relationship between an imbalance ratio and an air-fuel ratio fluctuation parameter.

FIG. 6 shows a relationship between an imbalance ratio IB and the air-fuel ratio fluctuation parameter X. As shown in FIG. 6, there is a strong correlativity between the imbalance ratio IB and the air-fuel ratio fluctuation parameter X. As the imbalance ratio IB increases, the air-fuel ratio fluctuation parameter X also increases. It should be noted herein that IB1 denotes a value of the imbalance ratio IB equivalent to a criterion as a boundary between a normality and an abnormality, and is equal to, for example, 60(%).

The principle of detecting a rich deviation abnormality according to this embodiment of the invention will be described using FIGS. 7A to 7D. In this embodiment of the invention, the air-fuel ratio fluctuation parameter X is used, the injection ratios $\alpha$ and $\beta$ are changed, and an air-fuel ratio deviation resulting from a malfunction in the intake system or the like, namely, an abnormality in the intake system is detected as well. A left state (I) in each of FIGS. 7A to 7D indicates a case where the injection ratio $\alpha$ is equal to a reference value A=40%. Besides, a right state (II) in each of FIGS. 7A to 7D indicates a case where the injection ratio $\alpha$ is equal to B=80%, which is larger than the reference value A. When a shift is made from the state (I) to the state (II), the injection ratio $\alpha$ changes from 40% to 80%, the injection ratio of the DI's 3 decreases from 60% to 20%, and the ratio of the port injection amount increases. In this case, an abnormality criterial value Z is tentatively determined as a value equivalent to the imbalance ratio equal to 20%.

Figure 7A:
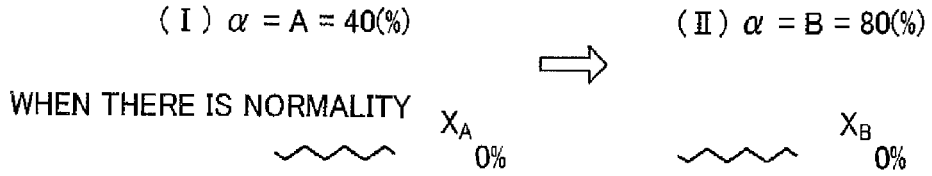
FIGS. 7A, 7B, 7C, and 7D are views for explaining the principle of detecting a rich deviation abnormality.

FIG. 7A shows a normal state where there is no abnormality in the PFI 2 and the DI 3 of any one of the cylinders and there is no abnormality in the intake system either. In this case, in the state (I), an air-fuel ratio fluctuation parameter $X_A$ equivalent to the imbalance ratio equal to 0% is obtained. In the state (II) as well, an air-fuel ratio fluctuation parameter $X_B$ equivalent to the imbalance ratio equal to 0% is obtained. There are established relationships: $X_A<Z$ and $X_B<Z$. In this case, it is determined that there is a normality.

Figure 7B:
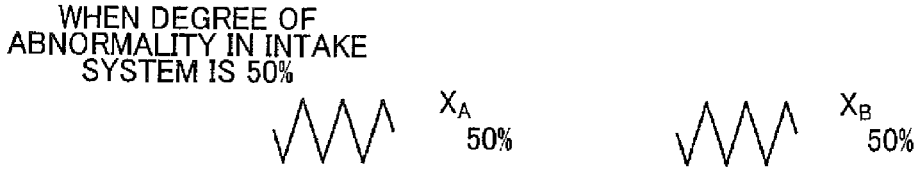

FIG. 7B shows an intake system 50% abnormality state where there is no abnormality in the PFI 2 and the DI 3 of any one of the cylinders but there is an abnormality equivalent to the imbalance ratio equal to 50% in the intake system. In this case, in the state (I), the air-fuel ratio fluctuation parameter $X_A$ equivalent to the imbalance ratio equal to 50% is obtained. In the state (II) as well, the air-fuel ratio fluctuation parameter $X_B$ equivalent to the imbalance ratio equal to 50% is obtained. If $X_A \geq Z$, $X_B \geq Z$, and $|X_A - X_B| < Y$ (Y is a predetermined reference value), it is determined that there is an abnormality in the intake system. Incidentally, the value of the air-fuel ratio fluctuation parameter X remains unchanged in the states (I) and (II) because the PFI's 2 and the DI's 3 are normal and hence the air-fuel ratio is free from the influence of changes in the injection ratio $\alpha$.

Figure 7C:
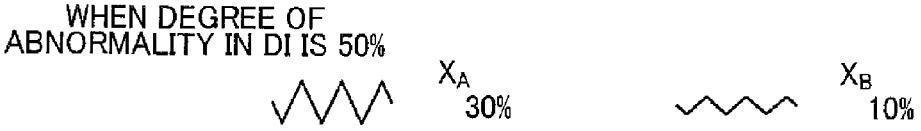

FIG. 7C shows a DI 50% abnormality state where there is an abnormality equivalent to the imbalance ratio equal to 50% in the DI 3 of one of the cylinders, there is no abnormality in the other PFI's 2 and the other DI's 3, and there is no abnormality in the intake system either. In this case, in the state (I), the air-fuel ratio fluctuation parameter $X_A$ equivalent to the imbalance ratio equal to 30% is obtained. This is because the injection ratio of the DI's 3 is equal to (100−40)=60(%), and 50%×60%=30%, that is, the influence of the abnormality in the DI 3 is reduced as a result of injection distribution. On the other hand, in the state (II), the air-fuel ratio fluctuation parameter $X_B$ equivalent to the imbalance ratio equal to 10% is obtained. This is because the injection ratio of the DI's 3 is (100−80)=20(%), and 50%×20%=10%. There are established relationships: $X_A \geq Z$ and $X_B<Z$, and it is determined in this case that there is an abnormality in the DI.

Figure 7D:
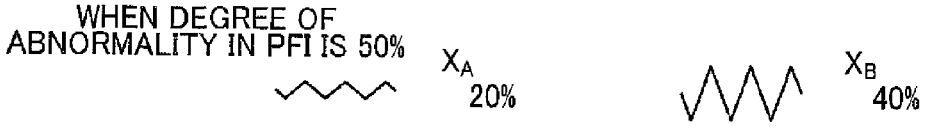

FIG. 7D shows a PH 50% abnormality state where there is an abnormality equivalent to the imbalance ratio equal to 50% in the PFI 2 of one of the cylinders, there is no abnormality in the other PFI's 2 and the other DI's 3, and there is no abnormality in the intake system either. In this case, in the state (I), the air-fuel ratio fluctuation parameter $X_A$ equivalent to the imbalance ratio equal to 20% is obtained. This is because the injection ratio of the PFI's 2 is equal to 40, and 50%×40%=20%, that is, the influence of the abnormality in the PFI 2 is reduced as a result of injection distribution. On the other hand, in the state (II), the air-fuel ratio fluctuation parameter $X_B$ equivalent to the imbalance ratio equal to 40% is obtained. This is because the injection ratio of the PFI's 2 is equal to 80%, and 50%×80%=40%. There are established relationships: $X_A<Z$ and $X_B \geq Z$, and it is determined in this case that there is an abnormality in the PFI. According to this principle, a rich deviation abnormality and an intake system abnormality are detected.

Figure 8:
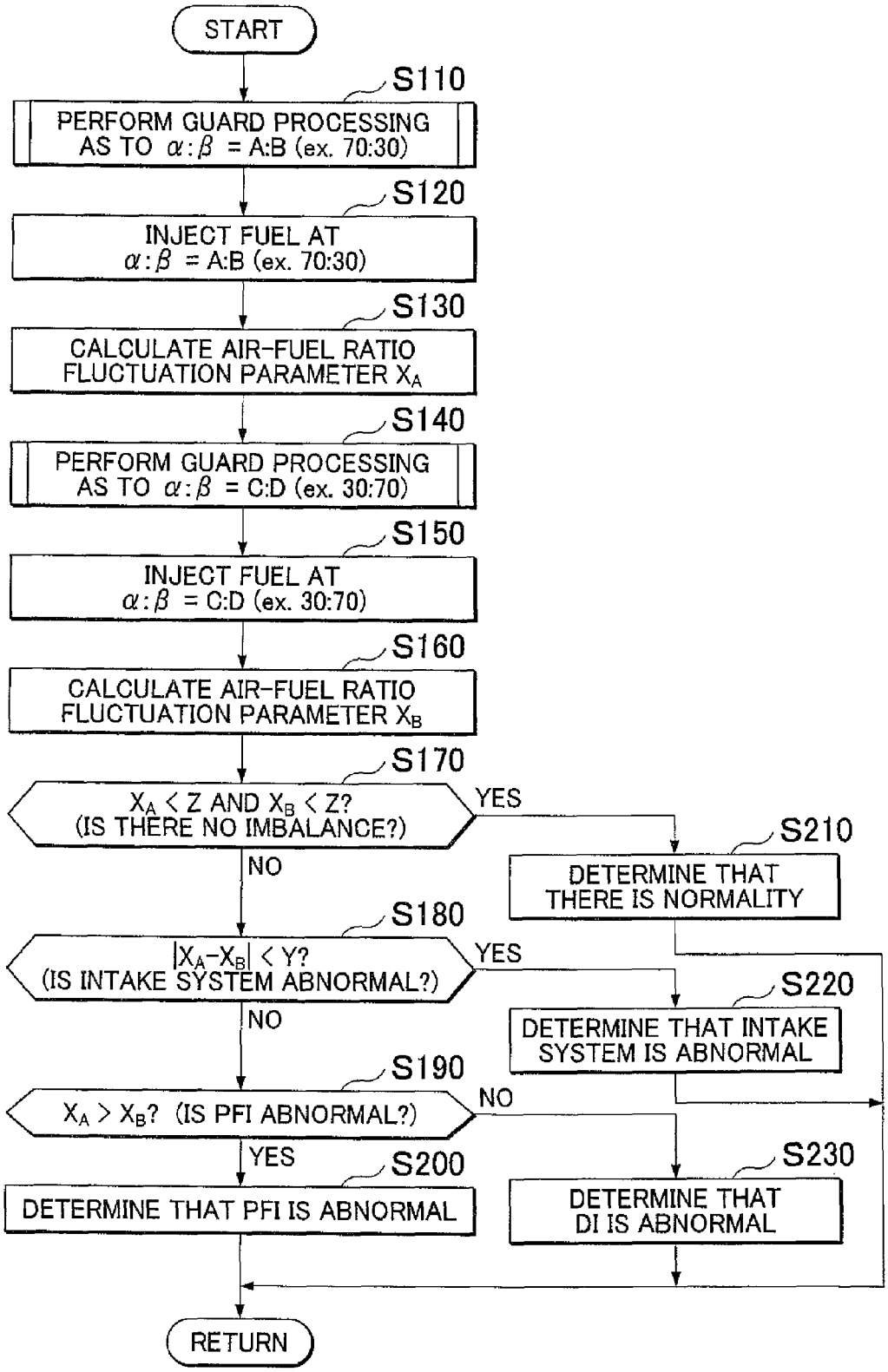
FIG. 8 is a flowchart showing a routine of a variation abnormality detecting processing.

FIG. 8 shows a routine of an air-fuel ratio variation abnormality detecting processing according to this embodiment of the invention. This processing is successively performed a predetermined plural number of times during one trip, at predetermined calculation timings, for example, every time a distance of 1000 km is traveled. By performing this processing a plural number of times during one trip, the accuracy can be enhanced because there is only a minor difference in detecting condition while the processing is performed the plural number of times. Besides, this processing is performed during steady traveling at or above a predetermined engine rotational speed or during gentle acceleration/deceleration, namely, under an operation condition other than abrupt acceleration and abrupt deceleration.

The ECU 100 performs a guard processing as to a case where fuel is injected with the ratios $\alpha$ and $\beta$ of injection from the PFI's 2 and the DI's 3 set equal to a first predetermined ratio A:B (e.g., 70:30) (S110). This guard processing is performed according to a subroutine shown in FIG. 9, and will be described later.

When the guard processing ends, the ECU 100 causes the PFI's 2 and the DI's 3 to inject fuel with the injection ratios α and β set equal to the first predetermined ratio A:B (e.g., 70:30) (S120). The ECU 100 then calculates the air-fuel ratio fluctuation parameter $X_A$ on the basis of the output of the pre-catalyst sensor 20 as an air-fuel ratio sensor (S130).

The ECU 100 performs a guard processing as to a case where fuel is injected with the injection ratios α and β set equal to a second predetermined ratio C:D (e.g., 30:70) (S140). This guard processing is also performed according to the subroutine shown in FIG. 9.

When the guard processing ends, the ECU 100 causes the PFI's 2 and the DI's 3 to inject fuel with the injection ratios α and β set equal to the second predetermined ratio C:D (e.g., 30:70) (S150). The ECU 100 then calculates the air-fuel ratio fluctuation parameter $X_B$ on the basis of the output of the pre-catalyst sensor 20 as an air-fuel ratio sensor (S160).

When the air-fuel ratio fluctuation parameters $X_A$ and $X_B$ are thus calculated, the ECU 100 makes a determination on an abnormality using these parameters (S170 to S230).

The ECU 100 first compares the air-fuel ratio fluctuation parameters $X_A$ and $X_B$ with the aforementioned abnormality criterial value Z respectively, and determines whether or not $X_A<Z$ and $X_B<Z$ (S170). This determination is a determination on "the absence of an imbalance". If the result of the determination in S170 is positive, it is determined that there is a normality (S210), this determination is recorded into a predetermined memory area, and the present routine is exited.

If the result of the determination in step S170 is negative (i.e., if there is an imbalance in the PFI's 2, the DI's 3, or the intake system), the ECU 100 then compares the absolute value of the difference between the air-fuel ratio fluctuation parameters $X_A$ and $X_B$ with a second abnormality criterial value Y (S180). This determination is equivalent to a determination on "the presence of an abnormality in the intake system". If the result of the determination in step S180 is positive, it is determined that the intake system is abnormal (S220), this determination is recorded into a predetermined memory area, and the present routine is exited.

If the result of the determination in step S180 is negative, namely, if there is an abnormality in either the PFI's 2 or the DI's 3, it is determined whether or not the air-fuel ratio fluctuation parameter $X_A$ is larger than the air-fuel ratio fluctuation parameter $X_B$ (S190). If the result of the determination in step S190 is positive, namely, if the air-fuel ratio fluctuation parameter $X_A$ is larger than the air-fuel ratio fluctuation parameter $X_B$, it is determined that there is an abnormality in the PFI's 2 (S200), this determination is recorded into a predetermined memory area, and the present routine is exited.

If the result of the determination in step S190 is negative, namely, if the air-fuel ratio fluctuation parameter $X_B$ is equal to or larger than the air-fuel ratio fluctuation parameter $X_A$, it is determined that there is an abnormality in the DI's 3 (S230), this determination is recorded into a predetermined memory area, and the present routine is exited.

Figure 9:
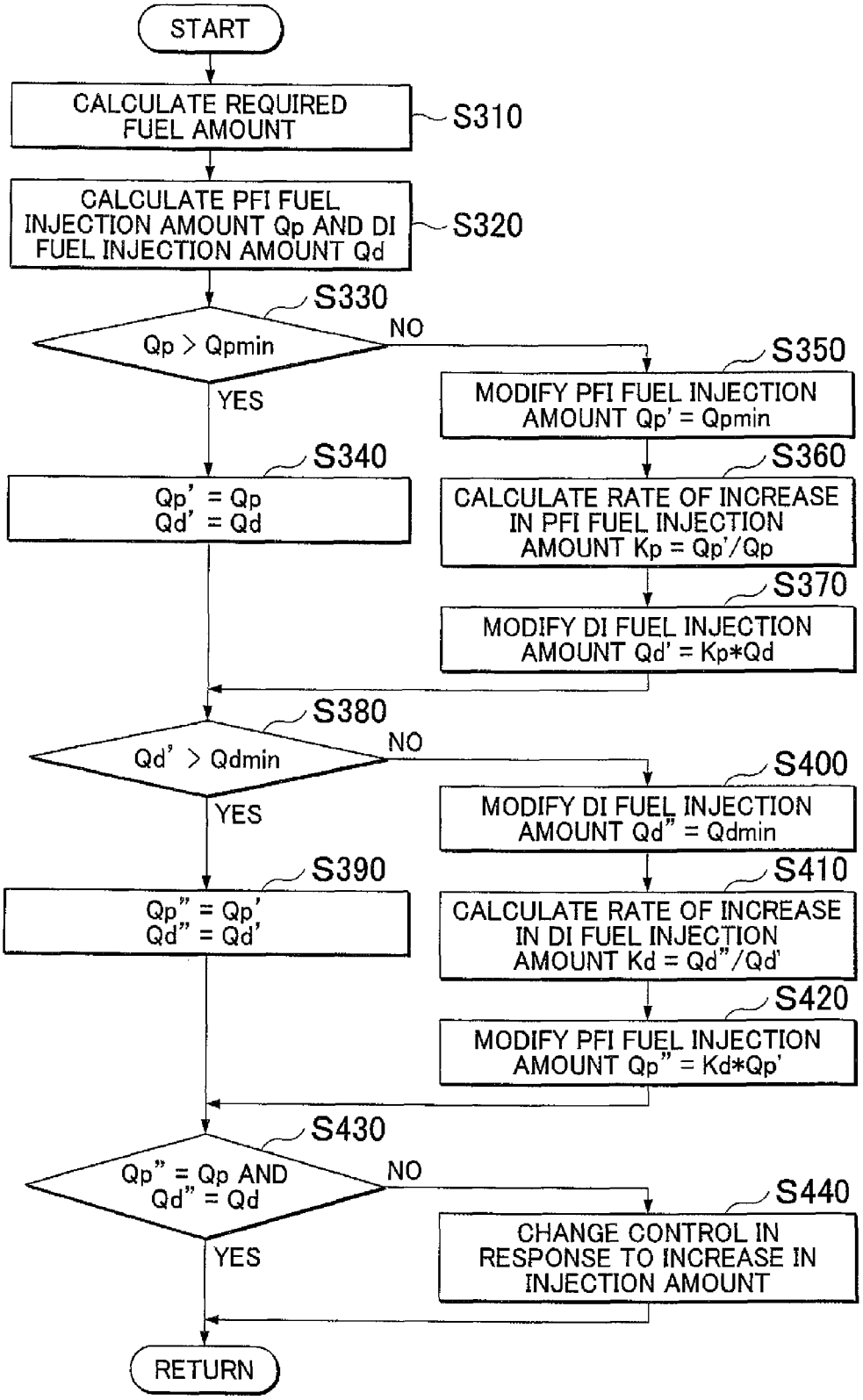
FIG. 9 is a flowchart showing a routine of a guard processing for increasing a fuel injection amount.

The guard processing of steps S110 and S140 is performed according to a subroutine of FIG. 9. The guard processing is a pre-processing that is performed prior to a determination on an abnormality. In the guard processing, if the fuel injection amount of any one of the fuel injection valves is smaller than a predetermined reference value in the case where fuel is injected at a predetermined injection ratio to detect an abnormality, the fuel injection amount is increased so as to become equal to or larger than the reference value.

In FIG. 9, the ECU 100 first calculates a total amount of fuel injected from the PFI's 2 and the DI's 3, namely, a required fuel amount (S310). This required fuel amount is an amount of fuel needed for traveling, and can be obtained referring to a map, on the basis of a current operation condition, namely, an engine rotational speed, a required load, and other predetermined parameters.

The ECU 100 then calculates fuel injection amounts $Q_p$ and $Q_d$, that is, amounts of fuel injected from the respective fuel injection valves 2 and 3 (S320). This calculation is carried out by allocating the required fuel amount to the respective fuel injection valves 2 and 3 according to the first predetermined ratio A:B (e.g., 70:30).

The ECU 100 then determines whether or not the port injection amount $Q_p$ as an amount of fuel injected from the PFI's 2 is larger than a predetermined port injection amount lower limit $Q_{pmin}$ (S330). This port injection amount lower limit $Q_{pmin}$ is determined in advance as a value at which an error in the injection amount cannot be tolerated when the port injection amount $Q_p$ is smaller than the port injection amount lower limit $Q_{pmin}$. If the result of the determination in S330 is positive, the error in the port injection amount $Q_p$ can be tolerated. Therefore, the current fuel injection amounts $Q_p$ and $Q_d$ are assigned to tentative values $Q_p'$ and $Q_d'$ respectively, and are retained (S340).

If the result of the determination in step S330 is negative, namely, if the port injection amount $Q_p$ is equal to or smaller than the port injection amount lower limit $Q_{pmin}$, an error in the port injection amount $Q_p$ cannot be tolerated, and hence the port injection amount $Q_p$ is modified (S350). More specifically, the port injection amount lower limit $Q_{pmin}$, is assigned to the tentative value $Q_p'$ of the port injection amount. Subsequently, a rate of increase $K_p$ in the port injection amount $Q_p$ resulting from this modification is calculated according to a calculation formula: $K_p=Q_p'/Q_p$ (S360). The calculated rate of increase $K_p$ is multiplied by the in-cylinder injection amount $Q_d$ as the fuel injection amount of the DI's 3, and the calculated product is assigned to the tentative value $Q_d'$ (S370).

The ECU 100 then determines whether or not the tentative value $Q_d'$ of the in-cylinder injection amount is larger than the in-cylinder injection amount lower limit $Q_{dmin}$ (S380). This in-cylinder injection amount lower limit $Q_{dmin}$ is determined in advance as a value at which an error in the injection amount cannot be tolerated when the in-cylinder injection amount $Q_d$ is smaller than the in-cylinder injection amount lower limit $Q_{dmin}$. The in-cylinder injection amount lower limit $Q_{dmin}$ may be either equal to or different from the port injection amount lower limit $Q_{pmin}$. If the result of the determination in step S380 is positive, an error in the in-cylinder injection amount $Q_d$ can be tolerated, and hence the tentative values $Q_p'$ and $Q_d'$ of the current fuel injection amount are assigned to final values $Q_p''$ and $Q_d''$ respectively, and are retained (S390).

If the result of the determination in step S380 is negative, namely, if the in-cylinder injection amount $Q_d$ is equal to or smaller than the in-cylinder injection amount lower limit $Q_{dmin}$, an error in the in-cylinder injection amount $Q_d$ cannot be tolerated, and hence the in-cylinder injection amount $Q_d$ is modified (S400). More specifically, the injection amount lower limit $Q_{dmin}$ is assigned to the final value $Q_d''$ of the in-cylinder injection amount. Subsequently, a rate of increase $K_d$ in the in-cylinder injection amount $Q_d$ resulting from this modification is calculated according to a calculation formula: $K_d=Q_d''/Q_d'$ (S410). The calculated rate of increase $K_d$ is multiplied by the tentative value $Q_p'$ of the port injection amount $Q_p$, and the calculated product is assigned to the final value $Q_p''$ (S420).

Finally, it is determined whether or not the final values $Q_p''$ and $Q_d''$ are equal to their original values $Q_p$ and $Q_d$ respectively (S430). If the result of the determination in step S430 is positive, the processing is returned. If the result of the determination in step S430 is negative, namely, if at least one of the fuel injection amounts $Q_p$ and $Q_d$ has been increased through the guard processing, the control is changed as a result of an increase in the injection amount (S440). The contents of the change in control resulting from this increase in the injection amount include (1) the prohibition of the air-fuel ratio feedback processing and (2) the prohibition of the air-fuel ratio learning processing. As a result, the air-fuel ratio feedback processing and the air-fuel ratio learning processing are not performed while the air-fuel ratio variation abnormality detecting processing shown in FIG. 8 is performed.

As described above in detail, in this embodiment of the invention, if the fuel injection amounts $Q_p$ and $Q_d$ of at least one of the plurality of the fuel injection valves are smaller than the predetermined reference values $Q_{pmin}$ and $Q_{dmin}$ respectively in the case where fuel is injected at the predetermined injection ratio for detecting an abnormality of air-fuel ratio variation, the ECU 100 increases each of the fuel injection amounts such that the fuel injection amount becomes equal to or larger than the reference value. Accordingly, the range where the injection amount is small is restrained from being utilized, and the accuracy of injection amount control is restrained from deteriorating. Thus, it is possible to favorably identify which of the fuel injection valves constitutes a cause of a variation abnormality.

In the case where the fuel injection amount or amounts of one or some of the fuel injection valves is or are increased, the ECU 100 increases the fuel injection amounts or amount of the other fuel injection valves or valve at the same ratio as the ratio of increase in the fuel injection amount. Accordingly, the injection distribution ratio can be maintained while restraining the accuracy of injection amount control from deteriorating. Incidentally, the rates $K_p$ and $K_d$ of increase in the fuel injection amounts or amount of the other fuel injection valves or valve may be equal to the rates of increase in the one or some of the fuel injection valves, or may be corrected for another purpose. It is sufficient that there be a certain corresponding relationship between the rates $K_p$ and $K_d$ of increase in the fuel injection amounts or amount of the other fuel injection valves or valve and the rates of increase in the one or some of the fuel injection valves.

The ECU 100 performs a prohibition processing of prohibiting the air-fuel ratio feedback processing and the air-fuel ratio learning processing from being performed while the fuel injection amount is increased as described above (S440). If the feedback processing and the learning processing are performed while the fuel injection amount is increased, the air-fuel ratio of exhaust gas is deviated toward the rich side as a result of the increase in the fuel injection amount. Thus, a value for reducing the fuel injection amount is given as an air-fuel ratio feedback correction coefficient $\gamma$. As a result, unstable combustion or misfire is caused by an excessive shift of the air-fuel ratio toward the lean side, and the emission properties deteriorate. In contrast with this, the feedback processing and the learning processing are prohibited while the fuel injection amount is increased in this embodiment of the invention. Thus, the air-fuel ratio feedback processing and the air-fuel ratio learning processing can be restrained from being influenced as a result of the increase in the fuel injection amount.

Although the embodiment of the invention has been described above in detail, various other modes of implementing the invention are conceivable. For example, an abnormality of variation of air-fuel ratio among the cylinders may also be detected on the basis of fluctuations in the rotational speed of the internal combustion engine. In this case, a ratio between a time needed to cause a crankshaft to rotate by 30° CA in the neighborhood of a top dead center (a TDC) in one of the cylinders and the time in the other cylinders can be adopted as an air-fuel ratio fluctuation parameter. Any value that is correlated with the degree of fluctuations in the output of the pre-catalyst sensor can also be adopted as an air-fuel ratio fluctuation parameter. For example, an air-fuel ratio fluctuation parameter can also be calculated on the basis of a difference between a maximum value of the output of the pre-catalyst sensor within one engine cycle and a minimum value of the output of the pre-catalyst sensor within one engine cycle (a so-called peak-to-peak difference). The difference increases as the degree of fluctuations in the output of the pre-catalyst sensor increases. An air-fuel ratio variation abnormality may be detected on the basis of an air-fuel ratio feedback correction amount.

As the change of control (S440) in the case where the fuel injection amount is increased (S370, S420), a processing for counterbalancing an unnecessary increase in torque may be additionally performed. As such a processing, one or two or more of the following measures, that is, (i) retardation of the ignition timing, (ii) reduction of the throttle opening degree, (iii) the control of a nozzle vane in an engine having a variable nozzle turbocharger, (iv) the control of the valve timing in an engine having a variable valve timing device, (v) the control of the valve lift amount in an engine having a variable valve lift amount device, (vi) the control of the amount of intake air in an engine having a variable intake system, and (vii) the recovery of kinetic energy in a hybrid vehicle can be adopted.

As another configuration, the guard processing (FIG. 9) may be performed, or the fuel injection amount may be increased (S370, S420) only in an operation state in which an unnecessary increase in torque can be tolerated, for example, only during idling.

In the foregoing embodiment of the invention, the single ECU 100 performs a series of processings including the control of the plurality of the fuel injection valves 2 and 3, the change of the injection ratio between the fuel injection valves 2 and 3, detection of an abnormality of air-fuel ratio variation, and the increase in the fuel injection amount. These processings may be performed through cooperation among a plurality of processors. In that case, the plurality of the processors constitute the controller in the invention.

In the invention, the number of cylinders of the engine, the type of the engine, and the application of the engine are not limited in particular. The engine may be a V-type engine or a horizontally-opposed engine. The number of fuel injection valves per cylinder may be an arbitrary plural number. The plurality of the fuel injection valves may be provided either in the intake port or in the cylinder. All the fuel injection valves may be provided in the intake port or in the cylinder. In the case of a spark ignition internal combustion engine such as a gasoline engine, an alternative fuel (a gaseous fuel such as alcohol, CNG, etc., or the like) can also be used. The term "predetermined" in the present specification widely encompasses values determined in advance. The predetermined value may be a variable value that is changed or dynamically acquired in accordance with an operation condition, as well as a fixed value.

The invention is not limited to the foregoing embodiment thereof. The invention includes all modification examples, application examples, and equivalents that are encompassed in the concept of the invention defined by the claims. Accordingly, the invention should not be interpreted in a limited manner, but is also applicable to any other art pertaining to the range of the concept of the invention.

What is claimed is:

1. An air-fuel ratio variation abnormality detecting device for an internal combustion engine that is equipped with a plurality of cylinders and a plurality of fuel injection valves that are provided for the plurality of the cylinders respectively, comprising:

a controller;

the controller being configured to calculate a required fuel injection amount that fulfills an operation condition of the internal combustion engine, the controller being configured to calculate fuel injection amounts that are amounts of fuel injected from the plurality of the fuel injection valves respectively based on the required fuel injection amount, the controller being configured to incrementally correct at least one of the fuel injection amounts such that the fuel injection amount becomes equal to or larger than a predetermined reference value, if the fuel injection amount is smaller than the reference value, the controller being configured to set a first injection ratio and a second injection ratio based on the incrementally corrected fuel injection amount, the first injection ratio and the second injection ratio being ratios between an amount of fuel injection from at least one first fuel injection valve and an amount of fuel injection from remaining second fuel injection valve in one cylinder respectively, and the first injection ratio and the second injection ratio having different value respectively, and the controller being configured to detect an abnormality of air-fuel ratio variation based on fluctuations in a predetermined output of the internal combustion engine at a time when fuel is injected at the first injection ratio and at a time when fuel is injected at the second injection ratio.

2. The air-fuel ratio variation abnormality detecting device according to claim 1, wherein the controller is further configured to incrementally correct the amount of fuel injection from the second fuel injection valve as well at a ratio corresponding to an incremental correction when the amount of fuel injection from the first fuel injection valve is incrementally corrected.

3. The air-fuel ratio variation abnormality detecting device according to claim 1, wherein the controller is further configured to perform an air-fuel ratio feedback processing of calculating an air-fuel ratio feedback correction amount such that an air-fuel ratio of exhaust gas coincides with a target air-fuel ratio, and correcting a fuel injection amount using the air-fuel ratio feedback correction amount, an air-fuel ratio learning processing of learning an air-fuel ratio learning value, which compensates for a steady deviation between an engine air-fuel ratio and a theoretical air-fuel ratio, based on the air-fuel ratio feedback correction amount, and causing the feedback processing to reflect the learned air-fuel ratio learning value, and a prohibition processing of prohibiting the air-fuel ratio feedback processing and the air-fuel ratio learning processing from being performed while the incremental correction is carried out.

4. An air-fuel ratio variation abnormality detecting method for an internal combustion engine that is equipped with a plurality of cylinders and a plurality of fuel injection valves that are provided for the plurality of the cylinders respectively, comprising:

calculating a required fuel injection amount that fulfills an operation condition of the internal combustion engine;

calculating amounts of fuel injected from the plurality of the fuel injection valves respectively based on the required fuel injection amount;

incrementally correcting at least one of the fuel injection amounts such that the fuel injection amount becomes equal to or larger than a predetermined reference value if the fuel injection amount is smaller than the reference value;

setting a first injection ratio and a second injection ratio based on the incrementally corrected fuel injection amount, the first injection ratio and the second injection ratio being ratios between an amount of fuel injection from at least one first fuel injection valve and an amount of fuel injection from remaining second fuel injection valve in one cylinder respectively, and the first injection ratio and the second injection ratio having different value respectively; and detecting an abnormality of air-fuel ratio variation based on fluctuations in a predetermined output of the internal combustion engine at a time when fuel is injected at the first injection ratio and at a time when fuel is injected at the second injection ratio.

* * * * *